United States Patent [19]

Kawasaki et al.

[11] Patent Number: 4,893,483

[45] Date of Patent: Jan. 16, 1990

[54] HEAT TREATMENT APPARATUS FOR BOBBINS OF YARN

[75] Inventors: Takuya Kawasaki, Takarazuka; Osamu Kawakami, Amagasaki, both of Japan

[73] Assignee: Nikku Industry Co., Ltd., Itami, Japan

[21] Appl. No.: 236,224

[22] Filed: Aug. 25, 1988

[30] Foreign Application Priority Data

Sep. 18, 1987 [JP] Japan ..... 62-232391
Sep. 26, 1987 [JP] Japan ..... 62-239975

[51] Int. Cl.[4] ..... D06B 3/04

[52] U.S. Cl. ..... 68/5 C; 68/5 D; 57/281; 57/276; 242/35.5 A; 28/285

[58] Field of Search ..... 68/5 C, 5 D; 242/35.5 A, 35.5 R; 57/281, 276; 28/285, 280

[56] References Cited

U.S. PATENT DOCUMENTS

| | | | |
|---|---|---|---|
| 3,344,622 | 10/1967 | Kronsbein | 68/189 X |
| 3,564,829 | 2/1971 | Tsuzuki | 68/5 D |
| 4,660,368 | 4/1987 | Kupper | 68/5 R |

FOREIGN PATENT DOCUMENTS

| | | | |
|---|---|---|---|
| 807203 | 6/1951 | Fed. Rep. of Germany | 68/5 C |
| 931511 | 10/1947 | France | 68/5 C |
| 709494 | 5/1954 | United Kingdom | 68/5 C |

*Primary Examiner*—Frankie L. Stinson
*Attorney, Agent, or Firm*—Browdy and Neimark

[57] ABSTRACT

In a heat treatment apparatus for bobbins of yarn having a plurality of heat treatment baths arranged between a spinning machine and a winding machine, the bobbins from the spinning machine are carried into the heat treatment baths by a conveyor line with pegs, the heat treatment is performed in the baths with the bobbins mounted on the pegs, and the heat-treated bobbins are automatically delivered from the baths onto another conveyor line with pegs installed on the winding machine side.

13 Claims, 4 Drawing Sheets

HEAT TREATMENT APPARATUS FOR BOBBINS OF YARN

BACKGROUND OF THE INVENTION

The present invention relates to apparatus for heat-treating or steam-setting bobbins of yarn produced by a spinning machine as the bobbins are transferred from the spinning machine to a winding machine.

In the spinning process, sliver of raw cotton, wool and synthetic fiber are spun into yarn which is wound on bobbins. The finished yarn on the bobbins is then wound by the winding machine into a so-called corn cheese or parallel cheese for the next process. This winding process of winding the yarn on a plurality of bobbins into a single parallel cheese or corn cheese requires the yarn ends to be joined.

The spun yarn produced by the spinning machine has a twisting torque which must be removed to obtain a stable quality of yarn. For this purpose, the bobbins of yarn are heat-treated, particularly, by steam. The steam heat treatment is important also in the yarn end joining process in the winding machine.

In the yarn end joining process, the ends of the spun yarn are drawn out by a carrier air flow and guided by the guide of the yarn end joining device where they are automatically joined. If there is a twisting torque in the spun yarn, the ends of the drawn yarn are not aligned in the direction of the carrier air flow direction, resulting in the yarn ends failing to be joined. For this reason, the bobbins of finished yarn are steam-set before being fed to the winding machine to remove the twisting torque.

Conventionally, the bobbins are randomly thrown into bobbin cases and several tens of these bobbin cases are loaded into an oven where they are heat-treated by steam.

In such a batch steam heat treatment process, the bobbins of spun yarn produced by the spinning machine are loaded into bobbin cases which are transported into the steam heat treatment room where a heat treatment oven is installed. The bobbin cases are placed in the steam oven and heated at a certain temperature for a prescribed period of time. After being heat-treated, the bobbin cases are carried to the winding machine where the bobbins are attached to the spindles of the winding machine.

In such a steam heat treatment procedure, the process of removing the bobbins from the spinning machine and that of fitting the bobbins on the winding machine are each automated independently. However, these processes require a transport path to carry a certain quantity of bobbins to the steam oven, load them into the oven for steam setting, and carry the heat-treated bobbins to the winding machine for winding on the spindles.

In other words, because the steam heat treatment process is provided independently of the spinning machine and the winding machine, the conventional bobbin heat treatment method requires at least five devices, i.e., a spinning machine, a carrying device, a steam heat treatment device, another carrying device, and a winding machine.

From the construction of the above-mentioned apparatus, the following processes are required: a preparatory process of loading a certain number of bobbins into each of the bobbin cases for transfer to the steam heat treatment device, a process of loading the bobbin cases into the steam heat treatment device for heat treatment, and a process of unloading the cases of heat-treated bobbins from the heat treatment device. These separate processes make the bobbin heat treatment process complicated and thus are the major obstacles in the way to an automated continuous series of processings. The essential point of this problem is the fact that the steam heat treatment process is independent of the spinning process and the winding process.

Although the temperature and time required for the vacuum heat treatment somewhat vary depending on the kind of yarn wound on the bobbins, such as whether the yarn is made of wool, cotton or mixed stuff with synthetic fiber, the following problems arise with the conventional steam heat treatment apparatus when the number of bobbins to be processed in a unit of time increases.

That is, the conventional steam heat treatment apparatus is designed to be installed between the spinning machine and the winding machine and is large in size, so that it is practically impossible to connect it to the spinning machine or winding machine.

SUMMARY OF THE INVENTION

This invention has been accomplished to eliminate the problem of the conventional steam heat treatment process that because the steam heat treatment device is installed independent of other devices, the heat treatment cannot be performed in an automated continuous series of processings.

For automated continuous processings, the bobbins must be able to be handled continuously. A well known example for this purpose is an auto-doffing device, in which empty bobbins are mounted on the spindles of the spinning machine and the fully wound bobbins are automatically removed from the spindle.

In this equipment, a steel belt is stretched around the spinning machine and has pegs for bobbin support erected in accordance with the spindle pitch. The steel belt is driven intermittently according to the doffing conditions.

In this equipment, since the pitch of the spindles on the spinning machine is aligned with that of the peg pitch, two or more fully wound bobbins can be removed from spindles and transferred onto the pegs on the steel belt by a clamping device which conforms to the pitch of the bobbins on the spindles.

In this case, if the peg pitch on the steel belt is set to half the spindle pitch on the spinning machine, the bobbin transfer can be made easy by putting an empty bobbin on every other peg and leaving the remaining pegs (one in every two pegs) unloaded.

That is, the fully wound bobbins removed from the spinning machine are held by the clamping device of the automatic transfer machine and mounted on every other pegs on the steel belt; with the clamping device slightly lifted, the steel belt is driven a half pitch to move an empty bobbin under the clamping device that has released the wound bobbin; and the clamping device then clamps the empty bobbin and is raised again to fit it over the spindle.

However, this auto-doffing equipment operates by moving around the spinning machine and cannot supply the bobbins continuously to the steam heat treatment device.

A major object of this invention is to provide a bobbin heat treatment apparatus installed between the spinning machine and the winding machine in which the bobbins are automatically supplied from the spinning machine to the heat treatment device and, after the batch heat treatment is done, the heat-treated bobbins are carried out of the heat treatment device toward the winding machine.

Another object of the invention is to provide a heat treatment apparatus that is compact enough to be installed between the spinning machine and the winding machine.

The construction of the invention that achieves the above objectives is characterized by: multiple parallel heat treatment baths installed between the spinning machine and the winding machine; a conveyor line for carrying bobbins of yarn from the spinning machine to the heat treatment baths; another conveyor line for carrying the heat-treated bobbins out of the heat treatment bath to the winding machine; means for automatically loading and unloading the bobbins to and from the multiple heat treatment baths alternately; and bobbin supporting pegs to enable the bobbins to be fed into the heat treatment baths while mounted on the pegs, and to be heat-treated by steam.

The apparatus of this invention is constructed so that the heat treatment on the bobbins produced by the spinning machine is performed at a part of the conveyor line that carries the fully wound bobbins from the spinning machine to the winding machine, and it is intended to make continuously operable the three processes of spinning, heat treating and winding.

For this purpose, multiple heat treatment baths are arranged between the spinning machine and the winding machine, and in the heat treatment baths the bobbins are moved mounted on the peg stands, or the bobbins are put on the peg stands erected in the heat treatment baths in which they are subjected to a series of heat treatment processes--evacuation, heating for a specified period of time, and vacuum breaking.

Broadly, the invention contains three embodiments. A first embodiment is characterized in that it uses peg stands in the bobbin transfer process and in the bobbin heat treatment process. A second embodiment is characterized in that pegs are erected in the heat treatment baths and that bobbins are mounted on the pegs.

In the first embodiment, a circulating conveyor passage including a conveyor line in the bath is formed; the bobbins that were carried on a conveyor line which has pegs and is installed on the spinning machine side are transferred onto the circulating conveyor passage; and the bobbins that were heat-treated in the bath are transferred onto the pegs on a conveyor line that is installed on the winding machine side.

In the second embodiment, two conveyor lines with pegs are installed one on the spinning machine side and the other on the winding machine side; multiple heat treatment baths are reciprocated in the lateral direction across these conveyor lines; the bobbins are removed from the spinning machine and mounted on the pegs in the heat treatment bath; and then the bobbins in the bath are removed from the pegs and transferred onto the pegs on the conveyor line on the winding machine side.

In the third embodiment, bobbins delivered on a peg-provided conveyor line on the side of a spinning machine and transferred onto peg stands are successively passed through a heat treatment bath, and heat-treated bobbins are successively transported to a winding machine intact as mounted on peg stands.

The multiple baths are alternately operated. To facilitate the connection between the baths and the conveyor lines, the multiple baths are arranged side by side and moved laterally to a position closest to each conveyor line where the bobbin transfer is carried out.

It is preferable that the parallelly arranged baths can be moved together alternately to a position where the bobbins are loaded and unloaded and to a position where the heat treatment is performed.

In that case, it is also desirable that the bobbins be loaded into and unloaded from the multiple baths at only one position to reduce the number of components of the loading and unloading device.

DESCRIPTION OF THE PREFERRED EMBODIMENTS

[First Embodiment]

Figure 1:
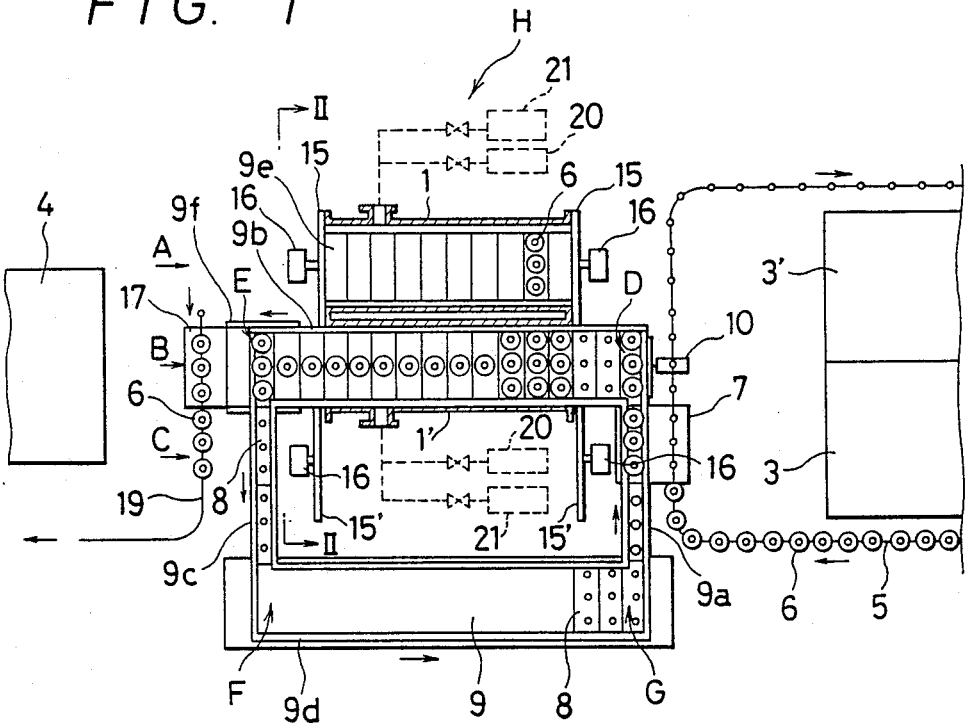
FIG. 1 is a plan view of heat treatment apparatus for bobbins of yarn according to a first embodiment of this invention.
Figure 2:
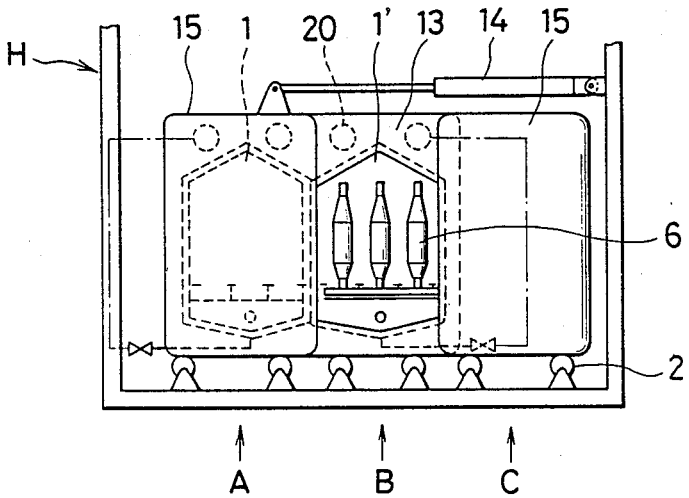
FIG. 2 is a front view of the apparatus as seen from the arrow II—II of FIG. 1.

The heat treatment apparatus of this embodiment, as shown in FIGS. 1 and 2, consists of two heat treatment baths 1 and 1' arranged parallel with respect to each other and connected together. These two heat treatment baths 1 and 1' are supported on rollers 2 so that they can be moved back and forth together in a direction across the length of a spinning machine 3.

As shown in FIG. 1, the heat treatment baths 1 and 1' are installed between the spinning machines 3 and 3' and the winding machine 4 to make the associated processes continuous. A conveyor line 5 is installed around the two spinning machines 3 and 3' that are arranged back-to-back. The bobbins 6 of yarn manufactured in the spinning process are transferred on the conveyor line 5.

A transfer device 7 installed on a part of the conveyor line 5 transfers the bobbins 6 from the conveyor line 5 onto peg stands 8 that move along a path passing through the heat treatment baths 1 and 1'.

Figure 3:
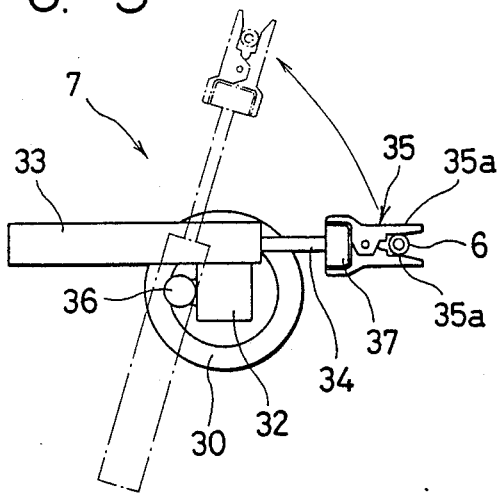
FIG. 3 is a plan view of an example of the transfer device.
Figure 4:
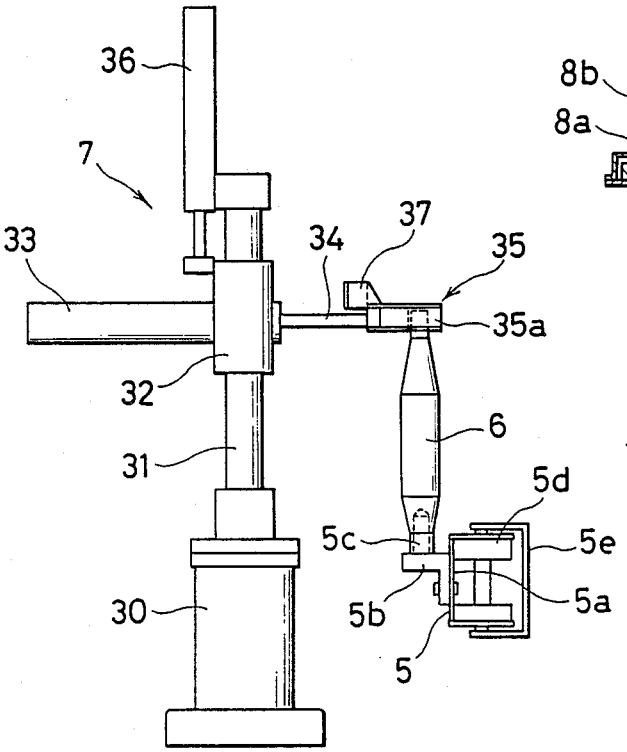
FIG. 4 is a front view of the transfer device.

As shown in FIGS. 3 and 4, the transfer device 7 has a rotating shaft 31 erected on its body 30 which contains a rotating device. A moving table 32 is slidably fitted over the rotating shaft 31. Provided on the moving table 32 is a longitudinal drive cylinder 33 that drives an arm 34. The arm 34 has a finger 35. The moving table 32 is moved up and down by a vertical drive cylinder 36 mounted to the rotating shaft 31. The finger 35 has a claw **35*a* which is opened or closed by a clamping cylinder 37 provided to the front end of the arm 34 to automatically clamp or release the upper part of the bobbin 6**.

The conveyor line 5, as shown in FIG. 4, consists of a steel belt **5*a*, brackets 5*b* attached to the steel belt 5*a* at predetermined intervals (corresponding to the pitch of the spindles in the spinning machine), pegs 5*c* erected on the brackets 5*b*, guides 5*d* fixed to the steel belt 5*a*, and a conveyor holder 5e that guides the guides 5d, the conveyor holder 5e** having a U-shaped cross section lying on its side.

Figure 5:
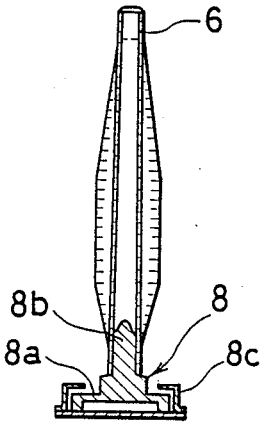
FIG. 5 is a perspective view of the peg stand that forms a circulation path for the bobbins.

The peg stand 8, as shown in FIG. 5, has a plurality of pegs 8b erected on a stand or base 8a. In this embodiment three pegs 8b are erected on one plate-like stand 8a. The peg stand 8 is guided by the guide 8c that supports the edges of the peg stand 8 so that the peg stand 8 is led through the path associated with the heat treatment baths 1 and 1'.

The guide 8c of the peg stand 8 comprises a member having a guide face having an L-shaped cross-section, in whose corner the lengthwise or widthwise corner of the stand 8a is engaged and guided.

The heat treatment apparatus H, as shown in FIG. 1, has a quadrilateral circulating path for peg stands 8 or conveyor line. On one side of the peg stand circulation passage, a load/unload section is formed through which the bobbins are loaded into the heat treatment apparatus for heat treatment and from which the heat-treated bobbins are unloaded. One side of the peg stand circulation passage is admitted into and discharged from the heat treatment bath 1 or 1'.

More specifically stated, the peg stand in the heat treatment baths 1 and 1' forms a part of the quadrilateral circulating passage used for loading and unloading the bobbins. It is enclosed in the bath 1 and 1' when the bobbins are heat-treated by steam.

A unit number of bobbins 6 (in this embodiment three) is transferred onto the peg stand 8 by the transfer device 7 and the peg stand 8 loaded with the bobbins 6 is moved to a position indicated by an arrow D (uppermost position in the figure) by a longitudinal conveyor 9a which is a part of a conveyor 9 forming the quadrilateral circulating path. At the position D, the peg stand 8 is pushed by a pusher 10 onto a lateral conveyor 9b which carries the peg stand 8 into the heat treatment bath 1'.

The conveyor 9 consists of two sets of longitudinal conveyors 9a, 9c and two sets of lateral conveyors 9b, 9d. A part of the lateral conveyor 9b is installed in the heat treatment bath 1 and 1' with the remaining part extending toward the inlet and outlet of the bath. The other lateral conveyor 9d is connected to the two longitudinal conveyors 9a and 9c. These four sets of conveyors 9a, 9b, 9c and 9d form a quadrilateral circulating path.

Though not shown in detail, the conveyor 9 is constructed so that it can be driven intermittently by a distance corresponding to the length or width of one peg stand 8 at a time. This conveyor means uses a device such as cylinder device, cam device, chain device, and so on which can intermittently move the peg stands by a prescribed distance.

As shown in FIG. 2, the heat treatment baths 1 and 1' are interconnected at the top and bottom by a connecting member, supported on the rollers 2 and reciprocated by a cylinder 14. At the end of the reciprocating motion of the baths 1 and 1', doors 15 and 15' are installed with a space therebetween to open and close the end openings of the baths. The doors 15 and 15' are driven by a cylinder 16 to close the openings of the baths.

In FIG. 1, the heat treatment bath 1 located at a position indicated by arrow A is undergoing the heat treatment process. After the heat treatment process, the bath 1 then moves from position A to position B where the heat treated bobbins 6 are delivered out from the left side of the bath 1 by a cylinder 10 which at the same time supplies untreated bobbins 6 successively into the bath from the right side. When the heat treatment bath 1' becomes full of the bobbins 6 held on the pegs 8b, the bath 1' moves from the position B to another position indicated by arrow C in the next process where the bath is closed by the door 15 to perform the heat treatment on the bobbins. At this time, the other heat treatment bath 1 is located at position B.

The bobbins 6 of yarn spun by the spinning machines 3 and 3' are transferred by the transfer device 7 (with the construction as shown in FIGS. 3 and 4) onto the peg stands 8 moving on the longitudinal conveyor 9a and, at the end of the lateral conveyor 9b, are pushed onto the lateral conveyor 9b by the pusher 10. At the same time the heat-treated bobbins 6 are pushed out of the lateral conveyor 9b from the other end.

When the heat treatment bath 1' is fully loaded with untreated bobbins 6, the cylinder 14 (FIG. 2) is activated to move the bath 1' to a position indicated by the arrow C where the doors 15 and 15' are firmly closed on both openings of the bath 1' by the cylinder 16.

Then in the heat treatment bath 1' the bobbins 6 are subjected to a series of heat treatment processes, starting from evacuation, steam injection and heating and ending with vacuum breaking.

On the other hand, the heat treatment bath 1, which has completed a series of heat treatment processes at position A and moved to the position B in the next process, is supplied untreated bobbins 6 on the peg stands 8 by the pusher 10. This causes the heat-treated bobbins 6 to be pushed out of the bath onto the lateral conveyor 9f (outlet conveyor) at the outlet of the bath 1 (left side) which carries them further to a position indicated by arrow E.

The heat-treated bobbins 6 carried to the position E are now transferred by the transfer device 17 (having a same structure as the transfer device 7) from the peg stands 8 onto another conveyor line 19 which carries them to the next process consisting of a winding machine 4.

The peg stands 8 from which the bobbins 6 were removed at position E are carried by the longitudinal conveyor 9c to a position indicated by arrow F, from which they are further carried by the lateral conveyor 9d to a position indicated by arrow G. From the position G the empty peg stands 8 are carried by the longitudinal conveyor 9a to the transfer device 7.

The heat treatment apparatus H of this embodiment according to the invention needs to have as simple a construction surrounding the baths 1 and 1' as possible. For this purpose, the two baths 1 and 1' are moved together to be connected to the conveyor 9 which forms a fixed circulating path for peg stands. And a vacuum pump 20 and a steam generator 21 are mounted on the top of the heat treatment baths 1 and 1' to reduce the installation space.

The number of bobbins 6 to be processed in a single heat treatment operation in the baths 1 and 1' is determined according to the number of spindles of the spinning machines 3 and 3', the count of yarn and the time required for the bobbin to be fully wound with yarn. At any rate, it is desirable to give some margin to the capacity of the machine.

In the above embodiment where two heat treatment baths 1 and 1' are installed side by side and are connected together for simultaneous movement, it is possible to increase the number of bobbins to be heat-treated by increasing the capacity of the bath or the number of baths. It is also possible to increase the heat treatment time.

If the heat treatment baths 1 and 1' are installed at fixed positions, the bobbins 6 may be distributed by a conveyor connected to the conveyor line 5 and the conveyor 9 and by a conveyor connected to the conveyor 9 and the conveyor line 19.

Generally, the heat treatment takes about 5 to 15 minutes and the loading and unloading of the bobbins 6 can be done in one-half to one-fifth of that time. This means that the total number of bobbins to be heat-treated in the system as a whole can be increased more easily by performing the heat treatment in the baths 1 and 1' at the fixed positions than by moving the baths.

When the number of heat treatment baths 1 and 1' is larger than two which is the case in the above embodiment, this invention can also be applied effectively by performing a series of heat treatment processes on the bobbins 6 in one bath while other baths are being loaded or unloaded with unprocessed bobbins 6.

In this embodiment, as shown in FIGS. 1 and 2 the vacuum pump 20 and the steam generator 21 used for the heat treatment are mounted on the baths 1 and 1' to simplify the surrounding structure of the heat treatment apparatus H and reduce the installation space. It is noted, however, that their locations are not limited to this.

Further, as to the peg stands 8, while this embodiment has three bobbins erected on the unit peg stand 8 as shown in FIG. 5, any number of bobbins may be mounted on each peg stand 8 and the number can be determined arbitrarily according to the number of bobbins 6 required by the heat treatment baths 1 and 1' and the installation space.

The features of the bobbin heat treatment apparatus of the above embodiment according to the invention are summarized below.

(1) A plurality of heat treatment baths are installed between the spinning machine and the winding machine with the peg stands carried on the circulating path that connects the inside and the outside of the bath.

(2) A conveyor is installed at least on the spinning machine side to automatically supply the bobbins to the feed section of the bath. A transfer device is installed between the conveyor on the spinning machine side and the feed section of the bath to automatically transfer the bobbins from the conveyor onto the peg stand.

(3) A plurality of baths are provided to enable the loading and unloading of bobbins to/from alternate baths.

The effects of the heat treatment apparatus of this invention may be summarized as follows.

(a) The bobbin cases and transport cart that were necessary for the conventional bobbin heat treatment process are obviated. The heat treatment room need not be installed in a separate location, increasing the freedom in the factory layout with many accompanying advantages.

(b) In the heat treatment apparatus of this invention, a plurality of baths is moved simultaneously so that the bobbins in one bath are subjected to heat treatment while another bath is being loaded and unloaded with the bobbins. This construction needs only one set of push-in and pull-out devices for loading and unloading the bobbins, thereby reducing the number of components.

Since the vacuum pump and steam generator used for heat treatment process are mounted on the top of the baths, the surrounding structure of the baths is simple and the installation space of the heat treatment apparatus as a whole is reduced.

(c) Furthermore, in the bobbin heat treatment apparatus of this invention since the bobbins are handled mounted on the peg stands during the heat treatment process, the surface of the bobbins can be prevented from being smeared or disturbed, ensuring a perfect and good heat treatment, which in turn improves the yield of products.

Also, since the bobbins carried by the conveyor line are transferred onto the peg stand a specified number at one time and are loaded into the heat treatment bath one peg stand at a time, any desired number of bobbins can be loaded or unloaded without a restriction imposed by the type of conveyor line that carries the bobbins from the spinning machine.

[Second Embodiment]

Figure 6:
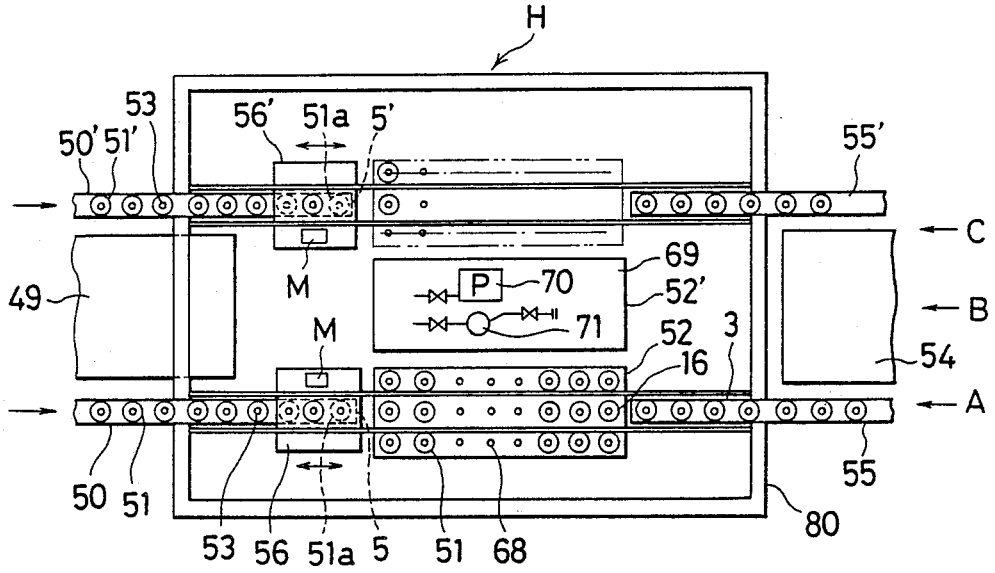
FIG. 6 is a plan view of heat treatment apparatus according to a second embodiment of the invention.
Figure 7:
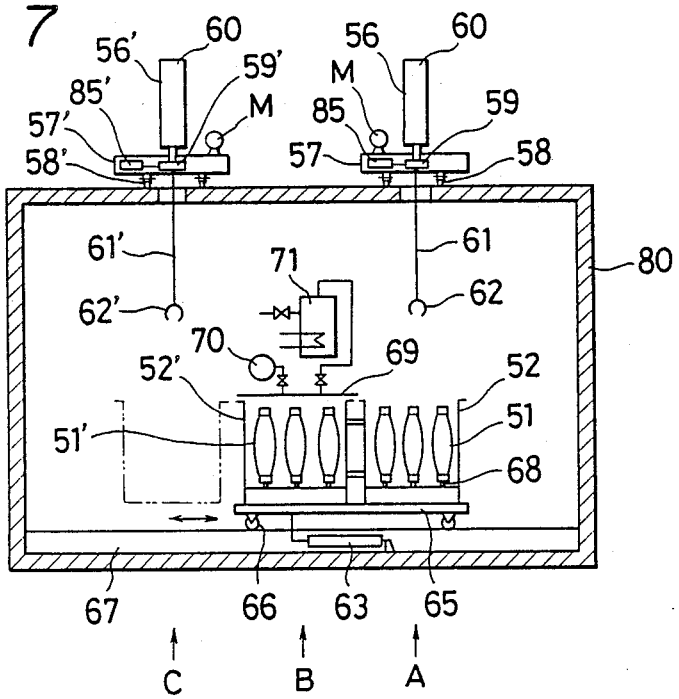
FIG. 7 is a cross-sectional view taken along the line VII—VII of FIG. 6.

FIGS. 6 and 7 show a bobbin heat treatment apparatus H representing a second embodiment of this invention. On both sides of the spinning machine 49 there are conveyor lines 50 and 50' provided with pegs 53 on which the bobbins 51 and 51' are mounted and carried into the heat treatment apparatus H.

The conveyor lines 50 and 50' on the upper paths advance toward one side of the heat treatment apparatus H and near the side of the apparatus make a U down turn and retracts along the lower return paths formed under the upper paths in much the same way as a crawler.

When the bobbins 51 and 51' arrive at position 51*a* at ends of the path of their travel, they are removed from the pegs 53 on the conveyor lines 50 and 50' and transferred to the heat treatment apparatus H.

When the heat treatment bath 52 or 52' comes to the center line between the two conveyor lines 51 and 51' indicated by an arrow B, the heat treatment apparatus H performs heat treatment by steam. At a position indicated by an arrow A or C that lies on the extension of the conveyor lines 50 and 50', the apparatus loads and unloads the bobbins 51 and 51'.

On the side opposite to the spinning machine 49 with respect to the heat treatment baths 52 and 52' there are provided a winding machine 54 and conveyor lines 55 and 55' on both sides of the winding machine 4. As shown in FIG. 7, provided above the heat treatment baths 52 and 52' are two bobbin transfer devices 56 and 56' which are moved on the rails (not shown in FIG. 7) toward the conveyor lines 50 and 50' or 55 and 55'.

The bobbin transfer devices 56 and 56' consist of a body 57, 57' and a traveling device 58, 58'. The traveling device 58, 58' under the body moves on the rail. The body 57, 57' has mounted thereon a laterally movable bobbin clamping device 59, 59'. Thus, the bobbin clamping device 59, 59' can be moved in the x and y directions with respect to the heat treatment baths 52, 52.

The bobbin clamping device 59, 59' has arms 61 and 61' that are driven by a cylinder 60, 60'. The arms 61 and 61' have clamping pieces 62 and 62' that clamp the upper end of the bobbins 51 and 51'.

As shown in FIG. 7, the heat treatment baths 52 and 52' are mounted on a common table 65 which moves on rail 67 by a traveling device 66. In this embodiment, the heat treatment baths 52 and 52' are of top-open type and has a plurality of pegs 68 erected at the bottom on which to mount the bobbins 51 and 51'.

In FIG. 7, above a central portion of a heat treatment chamber 80 a cover 69 is provided so as to be vertically movable. Under the cover 69 the bath 52 or 52' can be opened or closed when a specified period of time is reached. On the cover 69 are mounted associated devices such as vacuum pump 70 and hot water tank 71.

The heat treatment apparatus H with the above construction is operated in the following way.

When the bobbin 51, carried from left to right in FIG. 6 on the conveyor line 50 with pegs, comes to the right end position on the conveyor line 50, the arm 61 of the bobbin transfer device 56 moves down and holds the plurality of bobbins 51 with the clamping pieces 62 at the end of the arm 61. After gripping the bobbins 51, the arm 61 is raised to lift the bobbins 51 from the conveyor line 50 and mount them on the pegs 68 in the heat treatment bath 52.

Then, the clamping pieces 62 are raised by the cylinder 60 and returned to the position above the conveyor line 50. The clamping pieces 62 now grip new bobbins 51 and repeat the same operation to set the bobbins 51 in the heat treatment bath 52.

Since the bobbin clamping device 59 is made movable above the heat treatment bath 52 in the x- and y-axis directions, it is moved to a specified row of pegs 68 in the bath 52 on which it puts the corresponding number of bobbins 51. In this way, after the specified number of bobbins 51 are carried into the bath 52 and mounted on the pegs 68, the bobbin transfer device 56 returns to the home position over the conveyor line 50 and waits there.

As mentioned above, after the bobbins 51 are carried into the bath 52 and mounted on the pegs 68, the same process is repeated for the heat treatment bath 52' which is joined with the bath 52 and has the same structure and function as the bath 52. That is, the bobbins 51' carried on the conveyor line 50' on the opposite side are carried into the bath 52' and mounted on the pegs 68.

At this time, the bath 52 that was located at the position indicated by an arrow A of FIG. 6 is now moved to a position B, i.e., below the cover 69. The bath 52' that has performed the heat treatment by steam with the cover 69 closed then moves to a position C where the bath is shown with two-dot line Then, the bobbin transfer devices 56 and 56' carry the bobbins 51 and 51' into or out of the heat treatment baths 52 and 52' respectively.

As explained above, since the bath 52 is already loaded with the bobbins 51, it is ready to perform the steam-setting operation any time. When the bath 52 moves to the position B, it comes under the cover 69 which has the vacuum pump 70 and the hot water tank 71 mounted thereon and which can close and open the bath 52 by its vertical movement alone. When the bath 52 comes directly under the cover 69, the cover 69 is lowered to hermetically close the bath 52 by its weight.

After this, the bath 52 is evacuated by the vacuum pump 70 so that there is no need to clamp the cover 69. With the cover 69 closed on the bath 52, the bobbins 51 contained in the bath 52 are subjected to a series of heat treatment processes for steam setting according to a prescribed sequence.

While the bobbins 51 are steam-set in the bath 52, the other bath 52' moved to the position C is loaded with new bobbins 51' from the end position of the conveyor line 50' by the bobbin transfer device 56' to prepare for the next steam setting operation.

In this way, the heat treatment baths 52 and 52' are driven according to a predetermined sequence. That is, the bath 52 first completes the steam setting at the position B, and when the bath 52 returns to position A, the other bath 52' that was at position C moves to position B immediately below the cover 69 which is lowered to close the bath 52' to perform steam setting.

At this time, the bath 52 which contains the steam-set bobbins 51 arranged in many rows is not closed by the cover 69. The bobbin transfer device 56 clamps the upper part of the steam-set bobbins 51 by the clamping pieces 62 one row at a time in the procedure reverse to that used in carrying the bobbins 51 into the bath, and the bobbin transfer device 56 places them on the peg-attached conveyor line 55 on the side of the winding machine 54 to carry the heat-treated bobbins toward the winding machine 54.

In the meantime, the steam-set bobbins 51' in the bath 52' are also carried onto the peg-attached conveyor line 55' by the bobbin transfer device 56' in the same way that the steam-set bobbins 51 in the bath 52 were taken out.

In FIG. 7, denoted by 72 and 72' are motors of the bobbin transfer devices 56 and 56' for carrying the bobbins into or out of the baths. The base 65 common for both of the baths 52 and 52' is moved on the rail 67 by a bath driving cylinder 63.

[Third Embodiment]

Figure 8:
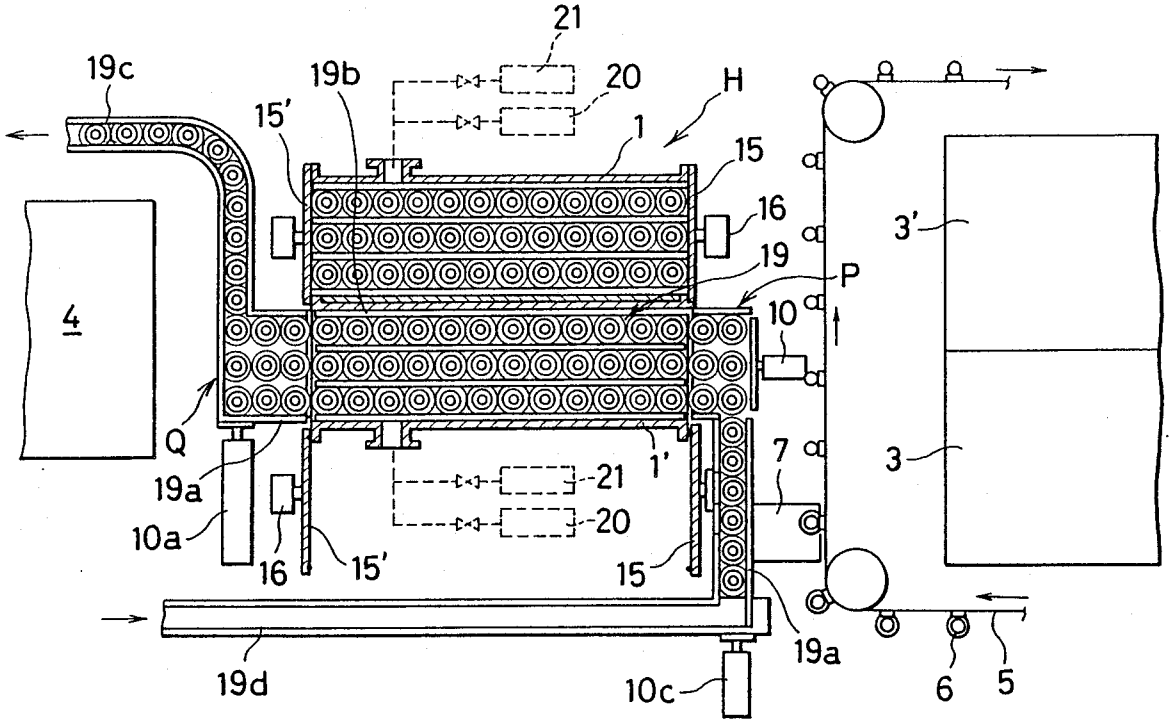
FIG. 8 is a plan view, illustrating a third embodiment of the invention.

As shown in FIG. 8 in conjunction with FIG. 1, the heat treatment apparatus according to the present embodiment of the invention comprises for example two juxtaposed heat treatment baths 1 and 1', and it has structural features and operational features substantially the same as the apparatus according to the above described first embodiment.

In greater detail, surrounding two spinning machines 3 and 3', a conveyor line 5 is provided, and bobbins 6 from a spinning step are transported by the conveyor line 5. A transfer device 7 is provided in a portion of the conveyor line 5, by which device the bobbins 6 are transferred onto peg stands 8 which are moved in a path connecting the heat treatment baths 1 and 1' together.

The conveyor line 5 and the transfer device 7 are designed and structured substantially the same as in the first embodiment. The peg stand 8 has a structure as shown in FIG. 5, and in the present embodiment, a single peg **8*b* is mounted on the stand 8*a*. As supported between a pair of L-shaped guides of a peg stand guide 8*c*, peg stands 8 are guided along the prescribed full path into, through and out of heat treatment baths 1 and 1'** without being permitted to fall.

According to this third embodiment, bobbins 6 of which the heat treatment has been finished are pushed out of the heat treatment baths 1 and 1' and, together with peg stands 8 on which they are mounted, successively transferred to the winding machine 4 on the conveyor line **19*c*. Then, after the bobbins 6 are taken up on the winding machine 4, the empty peg stands 8 are sent back onto a conveyor line 19*a* via the conveyor line 19*d*, and as fresh bobbins 6 are mounted thereon, the peg stands 8 are sent into the heat treatment baths 1 and 1'**.

With the peg stands 8, which individually carry a single bobbin 6 in the present embodiment, no particular limitation is applicable to the size thereof insofar as they have a size greater than the outer diameter of the bobbin 6, and their size does not depend on the pitch of the stands on the spinning machine. Herein an advantage is envisaged such that as the size of the peg stands is smaller, so can be the size of the heat treatment baths.

By the transfer device 7, bobbins 6 are one by one transferred onto peg stands 8, which are then conveyed by the longitudinal conveyor 19*a* to the point shown by an arrow P by the longitudinal conveyor 19*a*, a portion of the conveyor line 19, and at the point P, they are pushed one by one into the heat treatment baths 1 and 1' by a pusher 10. Further, the conveyor line 19 comprises the longitudinal conveyor line 19*a*, a conveyor 19*c* which conveys the bobbins from the outlet of the heat treatment baths generally shown by a letter Q to the winding machine 4, and a conveyor 19*d* for conveying back the empty peg stands 8 from the winding machine 4.

We claim:

1. A heat treatment apparatus for bobbins of yarn, comprising first and second heat treatment baths arranged parallel to each other and disposed between a spinning machine and a winding machine;

a conveyor line for supplying bobbins of yarn to be heat-treated from the spinning machine to said heat treatment baths, and another conveyor line for delivering heat-treated bobbins of yarn from said heat treatment bath, to the winding machine;

said heat treatment baths being movable in directions crossing the axial line of the spinning machine; and means provided for automatically alternating heat treatment of bobbins of yarn and replacement of bobbins in a manner such that while bobbins of yarn are heat-treated in either of said first and second heat treatment baths, replacement of heat-treated bobbins with bobbins to be heat-treated takes place in the other of said first and second heat treatment baths.

2. In a heat treatment apparatus for bobbins of yarn having a plurality of parallel heat treatment baths arranged between a spinning machine and a winding machine, said heat treatment apparatus comprising: a plurality of heat treatment baths which are movable (laterally) in the direction crossing the axis of the spinning machine; a peg stand carrying path formed in the heat treatment bath, the peg stand carrying path forming a part of a circulating passage; a conveyor line with pegs circulating around the spinning machine; a conveyor line with pegs circulating around the winding machine; and a bobbin transfer device installed between the first conveyor line around the spinning machine and the circulating passage and between the second conveyor line around the winding machine and the circulating passage; whereby the bobbins in the bath located at a position off the peg stand carrying path are heat-treated while another bath is being loaded with bobbins.

3. A heat treatment apparatus for bobbins of yarn as set forth in claim 2, wherein the multiple heat treatment baths are of a lateral and both-side open type and are joined together and reciprocated in the direction across the axis of the spinning machine, the bobbins are loaded into and unloaded from one of the heat treatment baths which is located on a part of the circulating passage, and the heat treatment is performed in the bath located at a position off the circulating passage.

4. A heat treatment apparatus for bobbins of yarn as set forth in claim 2, wherein the multiple heat treatment baths are laterally moved on rollers.

5. A heat treatment apparatus for bobbins of yarn as set forth in claim 2, wherein the peg stand can be mounted with a plurality of bobbins.

6. A heat treatment apparatus for bobbins of yarn as set forth in claim 5, wherein the multiple heat treatment baths are a top-open type and moved together across the axis of the spinning machine, their movements overlap each other by at least one bath position at the center of the heat treatment apparatus, the bath at the center position is closed by a cover for performing heat treatment on the bobbins, and the heat treatment baths located at other than the center position are opened at the top, so that the bobbins are transferred from the conveyor line on the spinning machine side into the heat treatment baths and also from the heat treatment baths onto the conveyor line on the winding machine side by bobbin transfer devices that travel above the heat treatment baths.

7. A heat treatment apparatus for bobbins of yarn as set forth in claim 5, wherein the bobbin transfer device can be moved in two directions, one along the bath movement and the other perpendicular to the bath movement.

8. A heat treatment apparatus for bobbins of yarn as set forth in claim 5, wherein major devices for heat treatment are mounted on the cover that closes the opening of the open type heat treatment baths.

9. A heat treatment apparatus for bobbins of yarn as set forth in claim 5, wherein the conveyor lines provided for automatic transfer of bobbins circulates in front of the spinning machine in such a way that the conveyor line returns at a position near the heat treatment baths but most remote from the spinning machine.

10. A heat treatment apparatus for bobbins of yarn as set forth in claim 5, wherein pegs on which to mount the bobbins are provided at certain intervals on the conveyor lines and in the heat treatment baths.

11. A heat treatment apparatus for bobbins of yarn, characterised by comprising: juxtaposed heat treatment baths arranged in series with a spinning machine and a winding machine; a circulatory path of transfer of peg stands, having as a portion thereof the inside of said heat treatment baths; and a bobbin transfer device arranged between a conveyor from said spinning machine and said circulatory path, whereby while bobbins from said spinning machine are loaded into one of said heat treatment baths kept in position in said circulatory path of transfer of peg stands, bobbins preparatively received in one of the heat treatment baths displaced out of the circulatory path are therein subjected to a heat treatment, bobbins of which the heat treatment has been finished being pushed out of the heat treatment baths and transferred onto a conveyor line forming the circulatory path in which said winding machine is included.

12. A heat treatment apparatus for bobbins of yarn as set forth in claim 11, wherein the circulating passage is a path which has a guide for guiding the peg stands.

13. In a heat treatment apparatus for bobbins of yarn having a plurality of parallel heat treatment baths arranged between a spinning machine and a winding machine, said heat treatment apparatus comprising: multiple heat treatment baths moved together across the axis of the spinning machine; a conveyor line for supplying the bobbins from the spinning machine to the heat treatment baths; and a conveyor line for delivering the heat-treated bobbins from the heat treatment baths to the winding machine; whereby the heat treatment is performed in one of the baths which is located at the center of the heat treatment apparatus and the bobbins are loaded into and unloaded from the bath which is located at either side of the apparatus.

* * * * *